US005371317A

United States Patent [19]

Masuda

[11] Patent Number: 5,371,317

[45] Date of Patent: Dec. 6, 1994

[54] MUSICAL TONE SYNTHESIZING APPARATUS WITH SOUND HOLE SIMULATION

[75] Inventor: Hideyuki Masuda, Hamamatsu, Japan

[73] Assignee: Yamaha Corporation, Japan

[21] Appl. No.: 511,060

[22] Filed: Apr. 19, 1990

[30] Foreign Application Priority Data

Apr. 20, 1989 [JP] Japan ..... 1-101307
Apr. 20, 1989 [JP] Japan ..... 1-101308
May 10, 1989 [JP] Japan ..... 1-116890

[51] Int. Cl.[5] ..... G10H 5/00

[52] U.S. Cl. ..... 84/659; 84/661; 84/DIG. 9

[58] Field of Search ..... 84/623, 647, 648, 653, 84/654, 656, 659-662, DIG. 9, DIG. 10, DIG. 26

[56] References Cited

U.S. PATENT DOCUMENTS 4,475,229 10/1984 Frese .
4,633,500 12/1986 Yamada et al. .
4,736,333 4/1988 Mead et al. ..... 364/736
4,736,663 4/1988 Wawrzynek et al. ..... 84/627
4,829,463 5/1989 Kakishita et al. ..... 84/661 X
5,157,214 10/1992 Nakanishi et al. ..... 84/622

FOREIGN PATENT DOCUMENTS 0248527 12/1987 European Pat. Off. ..... G10H 1/00

OTHER PUBLICATIONS

"Hobby-Musikelektronik", Eugen Gehrer, pp. 110-111.

*Primary Examiner*—William M. Shoop, Jr.
*Assistant Examiner*—Jeffrey W. Donels
*Attorney, Agent, or Firm*—Graham & James

[57] ABSTRACT

The musical tone synthesizing apparatus synthesizes a musical tone signal in response to the wind instrument and the like to thereby simulate a resonance tube providing with several sound holes each opened or closed by each finger of a performer. Herein, the input signal is delayed by the predetermined delay time, and then the predetermined operational process corresponding to the signal-scattering operation is carried out on the delayed signal. The coefficient used in this operational process is varied in response to the open/close state of each sound hole. Thus, the operation result can simulate the musical tone to be sounded from the resonance tube of the wind instrument and the like.

8 Claims, 5 Drawing Sheets

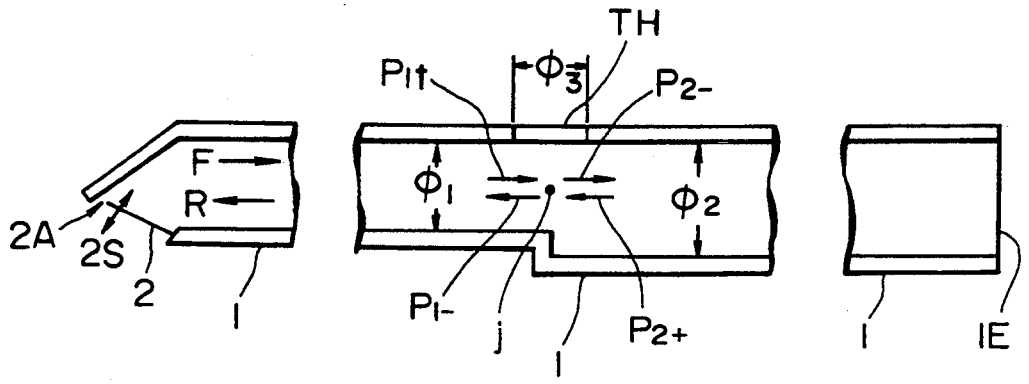
FIG. 1 *(PRIOR ART)*
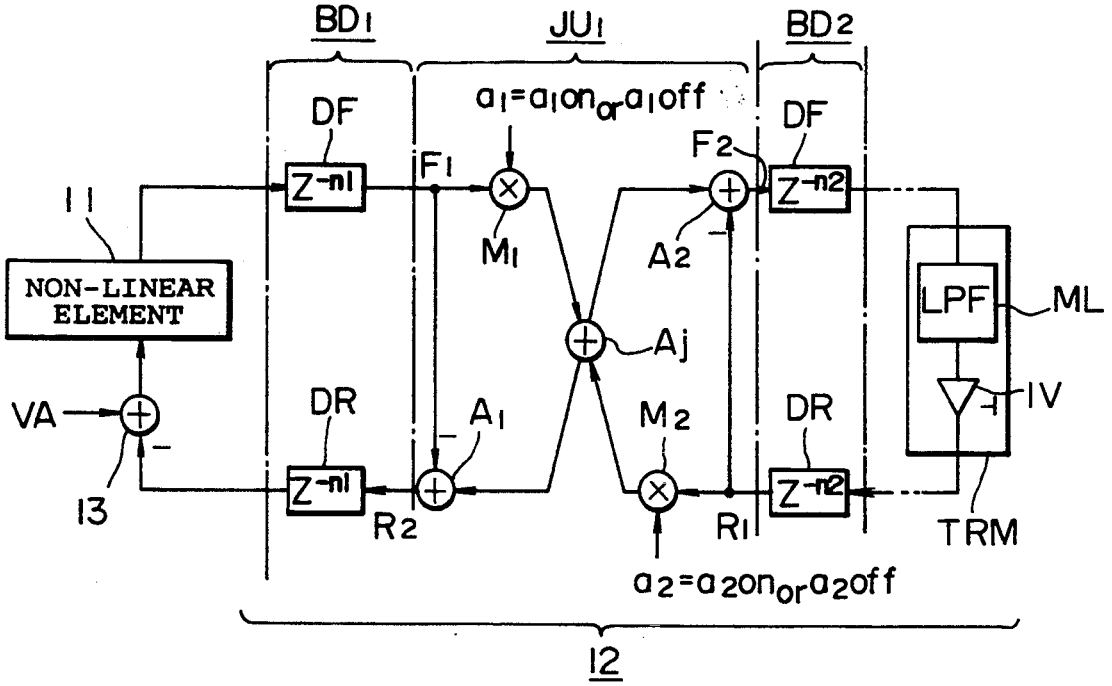
FIG. 2 *(PRIOR ART)*

MUSICAL TONE SYNTHESIZING APPARATUS WITH SOUND HOLE SIMULATION

BACKGROUND OF THE INVENTION

1. Field of the Invention

The present invention relates to a musical tone synthesizing apparatus which is suitable for the electronic wind instrument.

2. Prior Art

Conventionally known technique can synthesize the musical tone of non-electronic musical instrument (hereinafter, simply referred to as acoustic instrument) by operating the artificial tone-generation model which is obtained by simulating the tone-generation mechanism of acoustic instrument. Such musical tone synthesizing technique is disclosed in Japanese Patent Laid-Open Publication No. 63-40199, for example. Hereinafter, description will be given with respect to the modeling of the above-mentioned tone-generation mechanism of the wind instrument, and thereafter description will be further given to the conventional musical tone synthesizing apparatus using such modeling.

FIG. 1 is a sectional view showing the diagrammatical construction of the wind instrument such as the clarinet, saxophone etc. In FIG. 1, 1 designates a resonance tube and 2 designates a reed. In addition, TH designates a tone hole (or sound hole) which is formed at the predetermined position of the resonance tube 1.

When the performer blows breath 2A into the reed 2, the reed 2 vibrates due to blowing pressure PA and elastic characteristic thereof in direction 2S. As a result, pressure wave (i.e., compression wave) of air is produced in the vicinity of the reed 2 within the tube 1. Then, such compression wave progresses toward a terminal portion 1E of the tube 1 as progressive compression wave F. This progressive compression wave F is reflected by the terminal portion 1E and then returned to the reed 2 as reflected compression wave R, so that the reed 2 is affected by pressure PR due to reflected compression wave R. Therefore, when blowing the wind instrument, the reed 2 is affected by the following pressure P.

$$P=PA-PR \tag{1}$$

For this reason, the reed 2 will vibrate by the pressure P and elastic characteristic thereof- When the resonance state is established between the vibration of the reed 2 and the reciprocating motion of the compression waves F, R, the musical tone is generated from the wind instrument.

In this case, the resonance frequency is changed over by open/close operation of the tone hole TH formed at the tube 1. More specifically, when the open/close operation is carried out on the tone hole TH by the performer's finger, the flow of the compression wave is varied in the vicinity of the tone hole TH so that the substantial length of the tube is varied, whereby the resonance frequency is to be changed over.

FIG. 2 shows electric configuration of the conventional musical tone synthesizing apparatus which is obtained by simulating the tone-generation mechanism of the wind instrument. In FIG. 2, 11 designates a non-linear element which simulates the operation of the reed 2, 12 designates a resonance circuit which simulates the resonance tube 1, and 13 designates a subtractor which simulates the foregoing formula (1) to be operated by the reed 2. Herein, the output of the non-linear element 11 is applied to the resonance circuit 12 as progressive wave signal. Then, the resonance circuit 12 converts the progressive wave signal into reflected wave signal, which is supplied to the subtractor 13.

In the resonance circuit 12, $BD_1$, $BD_2$, . . . designate bi-directional transmission circuits each simulating the transmission delay characteristic of the compression wave which propagates in the resonance tube 1. In each of the bi-directional transmission circuits $BD_1$, $BD_2$ etc., DF designates a delay circuit for transmitting the progressive wave signal and DR designates another delay circuit for transmitting the reflected wave signal. Further, TRM designates a terminal circuit which simulates the reflection of the compression wave which is reflected at the terminal portion 1E of the resonance tube 1 (see FIG. 1). This terminal circuit TRM consists of a low-pass filter ML and an inverter IV. Herein, the low-pass filter ML simulates the acoustic loss which is occurred due to the reflection of the compression wave, while the inverter IV simulates the phase inversion of the compression wave to be reflected. Incidentally, this inverter IV is not requires when the terminal portion 1E is closed but required when the terminal portion 1E is opened.

Furthermore, $JU_1$ designates a junction circuit which simulates the scattering of the compression wave in the vicinity of the tone hole TH. In $JU_1$, $M_1$, $M_2$ designate multipliers; $A_1$, $A_2$ designate subtractors; and Aj designates an adder. The delay circuit DF in the bi-directional transmission circuit $BD_1$ outputs progressive wave signal $F_1$ to the multiplier $M_1$ wherein $F_1$ is multiplied by a coefficient $a_1$ so that multiplication result $a_1F_1$ is obtained. On the other hand, the delay circuit DR in the bi-directional transmission circuit $BD_2$ outputs reflected wave signal $R_1$ to the multiplier $M_2$ wherein $R_1$ is multiplied by another coefficient $a_2$ so that multiplication result $a_2R_1$ is obtained. Herein, the coefficients $a_1$, $a_2$ will be described later in detail. The adder Aj adds these two multiplication results together, and then its addition result is supplied to both of the subtractors $A_1$, $A_2$. The subtractor $A_1$ subtracts $F_1$ from the addition result of adder Aj to thereby output its subtraction result to the delay circuit DR in the bi-directional transmission circuit $BD_1$ as reflected wave signal $R_2$. On the other hand, the subtractor $A_2$ subtracts $R_1$ from the addition result of Aj to thereby output its subtraction result to the delay circuit DF in the bi-directional transmission circuit $BD_2$ as progressive wave signal $F_2$.

Next, description will be given with respect to the coefficients $a_1$, $a_2$ to be used in the multipliers $M_1$, $M_2$ with respect to two cases.

(i) First Case where the tone hole TH is opened:

The following formula (2) represents air pressure Pj at point j which is set in the vicinity of the tone hole TH in the tube 1 shown in FIG. 1.

$$Pj=a_{1\text{off}}\,P_{1+}+a_{2\text{off}}\,P_{2+} \tag{2}$$

Herein, $P_{l+}$ designates the pressure of the compression wave which enters into the point j from the reed 2, while $P_{2+}$ designates another pressure of the compression wave which enters into the point j from the terminal portion 1E. In addition, $a_{1\text{off}}$, $a_{2\text{off}}$ designate ratios of two pressures of compression waves, which can be represented by the following formulae (3), (4) respectively.

$$a_1\text{off}=2\phi_1^2/(\phi_1^2+\phi_2^2+\phi_3^2) \quad (3)$$

$$a_2\text{off}=2\phi_2^2/(\phi_1^2+\phi_2^2+\phi_3^2) \quad (4)$$

In the above formulae, $\phi_1$ designates the diameter of the tube 1 in reed side; $\phi_2$ designates the diameter of the tube 1 in terminal side; and $\phi_3$ designates the diameter of the tone hole TH. In FIG. 2, the progressive wave signal $F_1$ corresponds to the pressure $P_{1+}$, while the reflected wave signal $R_1$ corresponds to the pressure $P_{2+}$. In this first case where the tone hole TH is opened, the above-mentioned coefficients $a_1$off, $a_2$off are used as the foregoing coefficients $a_1$, $a_2$ of the multipliers $M_1$, $M_2$ respectively. For this reason, the adder Aj can output the operation result of foregoing formula (2), i.e., signal corresponding to the air pressure Pj at the point j in the tube 1.

Meanwhile, the following formulae (5), (6) respectively represent pressure $P_{1-}$ of the reflected compression wave which flows from the point j toward the reed 2 and pressure $P_{2-}$ of the progressive compression wave which flows from the point j toward the terminal portion 1E.

$$P_{1-}=Pj-P_{1+} \quad (5)$$

$$P_{2-}=Pj-P_{2+} \quad (6)$$

Thus, these pressures $P_{1-}$, $P_{2-}$ correspond to the outputs of the subtractors $A_1$, $A_2$ respectively.

(ii) Second Case where the tone hole TH is closed:

This case is equivalent to the state where the diameter $\phi_3$ of the tone hole TH is at "0". Therefore, coefficients $a_1$on, $a_2$on can be obtained by putting "$\phi_3=0$" in the foregoing formulae (3), (4) respectively.

$$a_1\text{on}=2\phi_1^2/(\phi_1^2+\phi_2^2) \quad (7)$$

$$a_2\text{on}=2\phi_2^2/(\phi_1^2+\phi_2^2) \quad (8)$$

These coefficients $a_1$on, $a_2$on are used as the foregoing coefficients $a_1$, $a_2$ of the multipliers $M_1$, $M_2$.

Thus, the adder Aj can output the signal corresponding to the air pressure Pj at the point j of the tube 1 in accordance with the following formula (9).

$$Pj=a_1\text{on}P_{1+}+a_2\text{on}P_{2+} \quad (9)$$

Then, the subtractors $A_1$, $A_2$ output signals corresponding to the pressures $P_{1-}$, $P_{2-}$.

As described heretofore, the circuit shown in FIG. 2 can simulate the scattering state of the compression wave in the tube 1 in response to the open/close operation of the tone hole TH.

In the present example of the conventional musical tone synthesizing apparatus, a bias value VA corresponding to the blowing pressure PA is applied to the non-linear element 11 via the subtractor 13. The output signal of the non-linear element 11 is transmitted to the terminal circuit TRM via the bi-directional transmission circuits $BD_1$, $BD_2$ and junction circuit $JU_1$ etc. In the junction circuit $JU_1$, values of the coefficients $a_1$, $a_2$ are changed over in response to the open/close operation of the tone hole TH as described before, and consequently the scattering state in the junction circuit $JU_1$ is changed over. The progressive wave signal reached at the terminal circuit TRM is processed by the low-pass filter ML and inverter IV so that the reflected wave signal is obtained. This reflected wave signal is transmitted through the circuits $BD_2$, $JU_1$, $BD_1$ etc. and then supplied to the non-linear element 11 via the subtractor 13. Thus, the resonance state is established between the non-linear element 11 and resonance circuit 12. In this case, the resonance frequency can be changed over by changing over the coefficients $a_1$, $a_2$ used in the junction circuit $JU_1$ in response to the open/close state of the tone hole TH.

In the actual performance of the wind instrument, the tone hole is gradually opened or closed by the performer's finger. However, the junction circuit of the above-mentioned conventional musical tone synthesizing apparatus can merely change over its operation in response to full-open and full-close states of the tone hole TH. For this reason, there is a problem in that the conventional apparatus cannot reproduce the real variation of the musical tone in response to the finger operation of the wind instrument.

Meanwhile, some wind instrument provides the tone hole portion which is projected from the tube as shown in FIG. 5. In such case, the compression wave is partially and discretely flown into the opening portion of the tone hole, and the compression wave is partially reflected by the opening portion of the tone hole. However, the conventional apparatus cannot simulate such projection of the tone hole portion. For this reason, there is a problem in that the conventional apparatus cannot simulate the wind instrument with accuracy.

In addition, the conventional apparatus as shown in FIG. 2 requires one junction circuit (including two multipliers, two subtractors and one adder) in order to carry out the operational process which simulates the operation of one tone hole. Therefore, there is a problem in that the hardware of the conventional apparatus must be enlarged. In contrast, when the above-mentioned operational process is carried out by the software to be executed by the digital signal processor (DSP) and the like, there is a problem in that the amount of software operations must be increased.

SUMMARY OF THE INVENTION

It is accordingly a primary object of the present invention to provide a musical tone synthesizing apparatus which can simulate the real variation of the musical tone in response to the actual finger operation of the wind instrument.

It is another object of the present invention to provide a musical tone synthesizing apparatus capable of simulating the operations of any types of the tone holes provided at the resonance tube of the wind instrument.

It is still another object of the present invention to provide a musical tone synthesizing apparatus capable of carrying out the operational process simulating the scattering state of the compression waves with small amount of software operations.

In a first aspect of the present invention, there is provided a musical tone synthesizing apparatus which simulates a resonance tube of a musical instrument having plural sound holes each opened or closed by each finder of a performer comprising:

(a) first and second signal processing means each delaying an input signal thereof with a predetermined delay time;

(b) junction means for carrying out a predetermined operational process on output signals of the first and second signal processing means to thereby effect scattering operation on the output signals of the first and second signal processing means, so that respective output signals of the junction means are fed back to the first and second signal processing means; and (c) sound hole information generating means for generating sound hole information representative of an open/close state of the sound hole to be gradually opened or closed, wherein coefficients used in the operational process to be carried out by the junction means are varied in response to the sound hole information so that a synthesized musical tone signal which simulates the musical instrument providing the resonance tube with plural sound holes is obtained based on a signal picked up from a loop consisting of the first and second signal processing means and the junction means.

In a second aspect of the present invention, there is provided a musical tone synthesizing apparatus comprising:

(a) first, second and third signal processing means each delaying an input signal thereof with a predetermined delay time; and (b) connecting means which connects the first, second and third signal processing means together, the connecting means carrying out a predetermined operational process on output signals of the first, second and third signal processing means so that respective output signals of the connecting means are fed back to the first, second and third signal processing means, wherein a synthesized musical tone signal is obtained by setting all of the first, second and third signal processing means and connecting means at resonance states respectively.

In a third aspect of the present invention, there is provided a musical tone synthesizing apparatus comprising:

(a) first and second signal processing means each delaying an input signal thereof with a predetermined delay time;

(b) third signal processing means for carrying out a frequency band control on an input signal thereof; and (c) connecting means which connects the first, second and third signal processing means together, the connecting means carrying out a predetermined operational process on output signals of the first, second and third signal processing means so that respective output signals of the connecting means are fed back to the first, second and third signal processing means respectively, wherein a synthesized musical tone signal is obtained by setting all of the first, second and third signal processing means and the connecting means at resonance states respectively.

In a fourth aspect of the present invention, there is provided a musical tone synthesizing apparatus comprising:

(a) excitation means for generating an excitation signal in response to performance information of a musical instrument;

(b) bi-directional transmission means for propagating the excitation signal outputted from the excitation means to a terminal portion as a progressive wave signal and also feeding back the excitation signal reflected by the terminal portion toward the excitation means as a reflected wave signal, so that a synthesized musical tone signal is obtained by setting both of the excitation means and the bi-directional transmission means at resonance states respectively;

(c) pitch information generating means for generating first and second coefficients concerning pitch information in response to the performance information, both of the first and second coefficients being used to designate a pitch of a musical tone to be generated;

(d) connecting means which is inserted in the bi-directional transmission means at its middle position which is determined such that a predetermined pitch can be obtained, the progressive wave signal reached at the middle position being multiplied by the first coefficient and then its multiplication result being added to the reflected wave signal reached at the middle position, thereafter addition result being outputted from the middle position of the hi-directional transmission means toward the excitation means; and (e) terminal means connected at the terminal portion of the bi-directional transmission means, the progressive wave signal supplied to the terminal means being multiplied by the second coefficient to thereby output its multiplication result as the reflected wave signal, wherein sum of the first and second coefficients is set lower than a predetermined value.

In a fifth aspect of the present invention, there is provided a musical tone synthesizing apparatus which simulates a resonance tube of a musical instrument having plural sound holes each opened or closed by each finger of a performer comprising:

(a) first and second signal processing means each delaying an input signal thereof with a predetermined delay time;

(b) junction means for carrying out a predetermined operational process on output signals of the first and second signal processing means to thereby effect scattering operation on the output signals of the first and second signal processing means, so that respective output signals of the junction means are fed back to the first and second signal processing means; and (c) computing means for computing open/close-degree of the sound hole to thereby produce sound hole information, the sound hole information representing an opening or closed state of the sound hole ranging between a full-open state and a full-closed state, wherein coefficients used in the operational process to be carried out by the junction means are varied in response to the sound hole information so that a synthesized musical tone signal which simulates the musical instrument providing the resonance tube with plural sound holes is obtained based on a signal picked up from a loop consisting of the first and second signal processing means and the junction means.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings:

FIG. 1 is a sectional view showing the diagrammatical construction of the wind instrument;

FIG. 2 is a block diagram showing the electric configuration of the conventional musical tone synthesizing apparatus;

DESCRIPTION OF PREFERRED EMBODIMENTS

Next, description will be given with respect to the preferred embodiments of the present invention.

[A] FIRST EMBODIMENT

Figure 3:
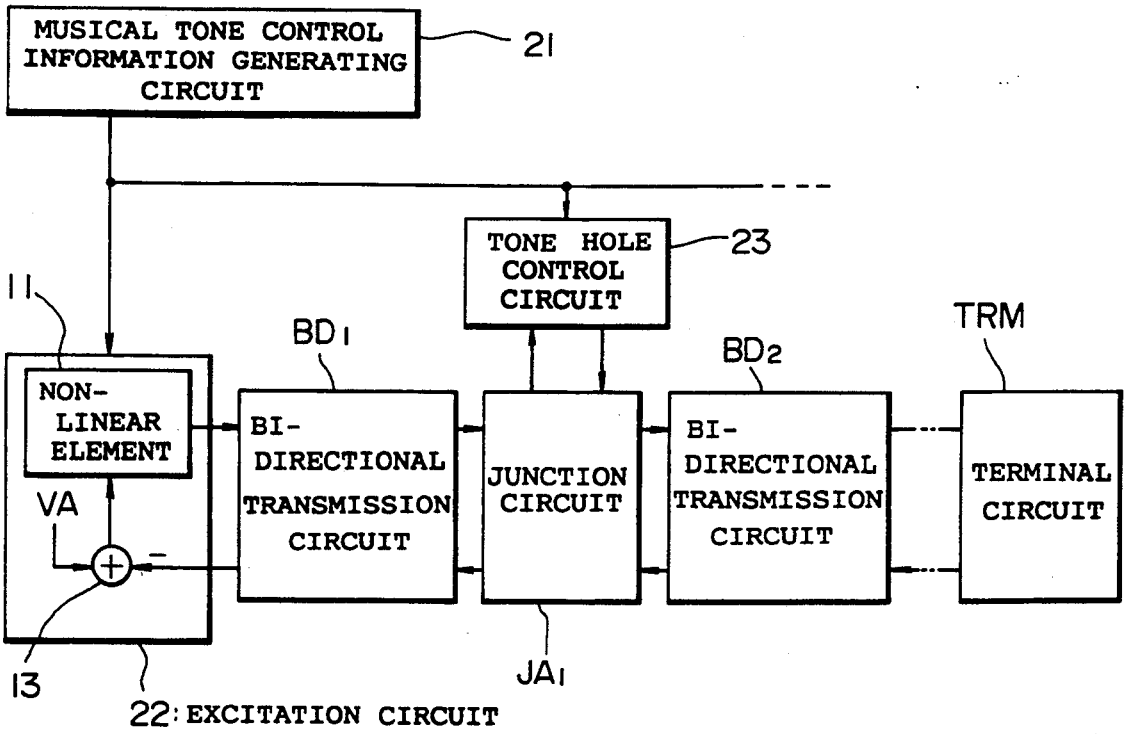
FIG. 3 is a block diagram showing an electric configuration of the musical tone synthesizing apparatus according to a first embodiment of the present invention.

FIG. 3 is a block diagram showing the electric configuration of the musical tone synthesizing apparatus according to the first embodiment of the present invention, wherein parts identical to those shown in FIG. 2 will be designated by the same numerals, hence, description thereof will be omitted. In FIG. 3, 21 designates a musical tone control information generating circuit which generates musical tone control information (indicative of open/close signal of tone hole, blowing intensity, note-on event, note-off event etc.) in accordance with the detected operation of each manual operable member provided on the wind instrument body (not shown). In addition, 22 designates an excitation circuit consisting of the foregoing non-linear element 11 and subtractor 13 shown in FIG. 2. Herein, the musical tone control information generating circuit 21 outputs the information VA representative of the blowing intensity to the subtractor 13 in the excitation circuit 22.

Figure 6:
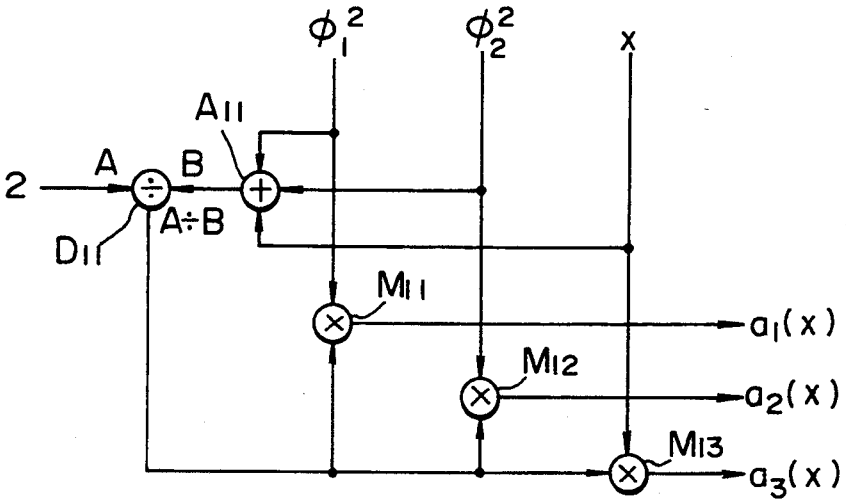
FIGS. 6 and 7 are circuit diagrams showing detailed configurations of coefficient operation circuits provided in the first embodiment.

Next, $JA_1$ designates a junction circuit corresponding to one tone hole. 23 designates a tone hole control circuit which controls coefficients used to carry out the operations in the junction circuit $JA_1$ in accordance with the open/close signal of tone hole. The tone hole control circuit 23 contains the coefficient operation circuit as shown in FIG. 6. In FIG. 6, $M_{11}$, $M_{12}$, $M_{13}$ designate multipliers, $A_{11}$ designates an adder and $D_{11}$ designates a divider.

Incidentally, FIG. 3 illustrates the circuit portion (i.e., 22, $BD_1$, $JA_1$, $BD_2$) corresponding to the instrument portion defined from the reed to first tone hole and another circuit portion (i.e., TRM) corresponding to the terminal portion of the resonance tube, however, the circuit portions corresponding to other instrument portions are omitted from FIG. 3. In other words, bidirectional transmission circuits $BD_3$, . . . , $BD_n$ (wherein $BD_n$ is the closest to the terminal circuit TRM) corresponding to the tube length, junction circuits JA and other tone hole control circuits corresponding to other tone holes are provided between $BD_2$ and TRM in FIG. 3, however, they are omitted from FIG. 3.

Figure 4:
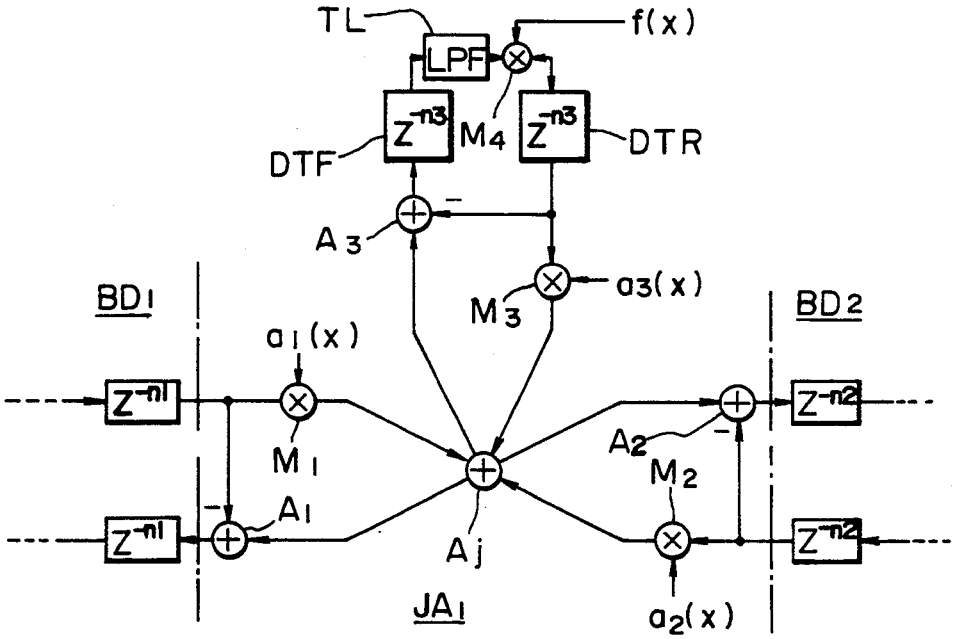
FIG. 4 is a circuit diagram showing a detailed configuration of a junction circuit shown in FIG. 3.
Figure 5:
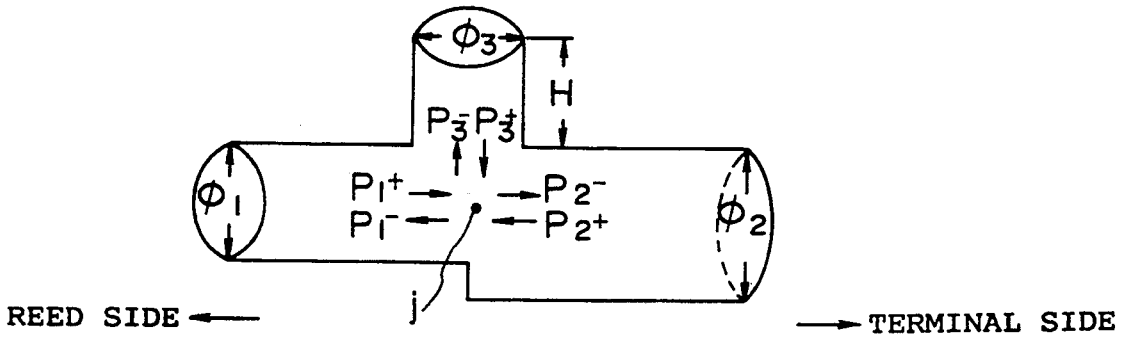
FIG. 5 is a simulation model of another type of wind instrument to be used in the first embodiment.

FIG. 4 is a block diagram showing the circuit configuration of the junction circuit $JA_1$, wherein parts identical to those shown in FIG. 2 are designated by the same numerals, hence, description thereof will be omitted. This junction circuit $JA_1$ is designed to simulate the tone hole which is projected from the tube as shown in FIG. 5. When such tone hole is opened, the compression wave of air which is blown from the tube toward the outside via the tone hole at pressure $P_{3-}$ is partially reflected by the opening of tone hole, and then the reflected compression wave of air is flown into the tube from the tone hole at pressure $P_{3+}$. Thus, the following air pressure Pj will be caused at point j in the vicinity of the tone hole in the tube.

$$Pj=a_1P_{1+}a_2P_{2+}+a_3P_{3+} \quad (10)$$

As described before, $P_{1+}$ represents the pressure of the progressive compression wave of air which is flown into point j from the reed, while $P_{2+}$ represents the pressure of the reflected compression wave of air which is flown into point j from the terminal portion of the tube. In this case, the coefficients can be obtained from the following formulae.

$$a_1=2\phi_1^2/(\phi_1^2+\phi_2^2+\phi_3^2) \quad (11)$$

$$a_2=2\phi_2^2/(\phi_1^2+\phi_2^2+\phi_3^2) \quad (12)$$

$$a_3=2\phi_3^2/(\phi_1^2+\phi_2^2+\phi_3^2) \quad (13)$$

On the other hand, when the tone hole is closed, the coefficients can be obtained from the following formulae.

$$a_1=2\phi_1^2/(\phi_1^2+\phi_2^2) \quad (14)$$

$$a_2=2\phi_2^2/(\phi_1^2+\phi_2^2) \quad (15)$$

$$a_3=0$$

In addition, $P_{1-}$ represents the pressure of the reflected compression wave of air which is flown toward the reed from point j; $P_{2-}$ represents the pressure of the progressive compression wave of air which is flown toward the terminal portion from point j; and $P_{3-}$ represents the pressure of the compression wave of air which is flown through the tone hole from point j. These pressures can be obtained from the following formulae.

$$P_{1-}=Pj-P_{1+} \quad (17)$$

$$P_{2-}=Pj-P_{2+} \quad (18)$$

$$P_{3-}=Pj-P_{3+} \quad (19)$$

In FIG. 4, delay circuits DTF, DTR simulate the propagation delay of the compression wave of air which flows through the tube-like portion of the tone hole, wherein the delay times thereof are determined in response to height H of such tube-like portion of the tone hole. In addition, TL designates a low-pass filter (LPF) which simulates the acoustic loss due to the reflection of the compression wave of air at the terminal portion of the tone hole; and $M_4$ designates a multiplier which simulates the reflection of the compression wave of air at the tip edge portion of the tone hole. In addition, $A_3$, $M_3$ designate a subtractor and a multiplier respectively which simulate the flow control of the compression wave of air to be flown from the tube to the tone hole and to be flown from the tone hole to the tube.

Hereinafter, description will be given with respect to the operation of the musical tone synthesizing apparatus. When the musical tone control information generating circuit 21 generates the blowing pressure information and note-on signal, the value VA corresponding to the blowing pressure is supplied to the non-linear element 11 via the subtractor 13. At this time, the non-linear element 11 is at the enable state so that the output thereof is transmitted to the terminal circuit TRM via the hi-directional transmission circuit $BD_1$, junction circuit $JA_1$, bi-directional transmission circuit $BD_2$ etc. Then, the reflected wave signal from the terminal circuit TRM is transmitted back to the non-linear element 11 via $BD_2$, $JA_1$, $BD_1$ etc. and 13. Thus, the excitation circuit 22 and resonance circuit (consisting of $BD_1$, $JA_1$, $BD_2$ etc. & TRM) are set in the resonance state so that the synthesized musical tone can be picked up.

In the above-mentioned state, a control variable "x" used in the tone hole control circuit 23 is varied in accordance with the tone hole open/close signal outputted from the musical tone control information generating circuit 21. When the tone hole open/close signal represents "tone hole open state", the control variable x is gradually varied from "0" to "$\phi_3^2$" (where $\phi_3$ designates the diameter of tone hole) in lapse of time. Such variation of the control variable x corresponds to the variation of the substantial opening area of tone hole when the performer releases his finder off from the tone hole. On the other hand, when the tone hole open/close signal represents "tone hole close state", the control variable x is gradually varied from "$\phi_3^2$" to "0" in lapse of time. Such control variable x is applied to the coefficient operation circuit shown in FIG. 6, so that this coefficient operation circuit will carry out the following coefficient operations.

$$a_1(x)=2\phi_1^2/(\phi_1^2+\phi_2^2+x) \quad (20)$$

$$a_2(x)=2\phi_2^2/(\phi_1^2+\phi_2^2+x) \quad (21)$$

$$a_3(x)=2x/(\phi_1^2+\phi_2^2+x) \quad (22)$$

Then, the operational results, i.e., $a_1(x)$, $a_2(x)$, $a_3(x)$ are respectively supplied to the multipliers $M_1$, $M_2$, $M_3$ shown in FIG. 4 so that the level of each signal to be supplied to the adder Aj is controlled. As described above, the circuits shown in FIGS. 4 and 6 can carry out the signal processings which simulate the variation of the scattering state of the compression wave of air in the vicinity of the tone hole when the performer gradually opens the tone hole or gradually closes the tone hole by his finger.

At the same time, the tone hole control circuit 23 computes the coefficient f(x) used for the multiplier $M_4$. Incidentally, the circuit used to compute such coefficient f(x) is omitted from the drawings of the present invention. Herein, when $x=0$ representing the full close state of tone hole, $f(0)=1$; when $x=\phi_3^2$ representing the full open state of tone hole, $f(\phi_3^2)=-1$. If x gradually increases from "0" to "$\phi_3^2$", the coefficient f(x) gradually decreases from "1" to "−1". Then the computed coefficient f(x) is supplied to the multiplier $M_4$. As described above, the computation of f(x) corresponding to the signal processings which simulate the variation of the reflection characteristic of the compression wave of air to be reflected at the tip edge portion of tone hole when the performer gradually opens and closes the tone hole by his finger. Due to the variation of the coefficients $a_1(x)$, $a_2(x)$, $a_3(x)$, f(x), the resonance waveform to be generated from the present musical tone synthesizing apparatus is varied. Thus, it is possible to reproduce the variation of musical tone signal when the performer gradually opens and closes the tone hole.

Figure 7:
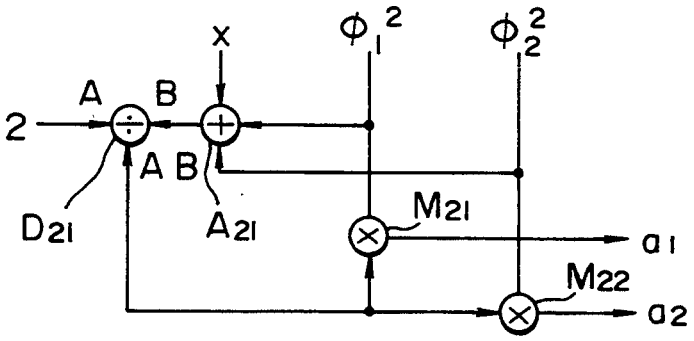

The above description relates to the wind instrument of which tone hole is projected from the tube as shown in FIG. 5. Next, description will be given with respect to the wind instrument of which tone hole is cut through the tube as shown in FIG. 1 (i.e., the height H of tone hole is zero). In this instrument, the junction circuit $JU_1$ shown in FIG. 2 is applied as the junction circuit $JA_1$, and circuit as shown in FIG. 7 is used as the coefficient operation circuit of the tone hole control circuit 23. In FIG. 7, $M_{21}$, $M_{22}$ designate multipliers, $A_{21}$ designates an adder and $D_{21}$ designates a divider. When the control variable x representative of the opening degree of tone hole is applied to this circuit shown in FIG. 7, the foregoing operations of formulae (20), (21) are executed so that the coefficients $a_1(x)$, $a_2(x)$ are obtained. Then, these coefficients $a_1(x)$, $a_2(x)$ are supplied to the multipliers $M_1$, $M_2$ as $a_1$, $a_2$ in the junction circuit $JU_1$ as shown in FIG. 2. Thus, as similar to the tone hole shown in FIG. 5, it is possible to reproduce the variation of musical tone when the performer gradually opens and closes the tone hole as shown in FIG. 1.

The first embodiment discloses the musical tone synthesizing apparatus according to the present embodiment. However, the present embodiment is not limited to such apparatus, hence, it is possible to modify the present embodiment to the reverberation effect applying apparatus, for example. In this case, it is possible to simulate the variation of reverberation effect which is caused when the performer opens or closes the hole provided in the sound field of the reverberation effect applying apparatus. In addition, it is possible to apply the present embodiment to the apparatus which simulates the vibration of string of the string instrument when the performer slightly touches the string by his finger and the like.

[B] SECOND EMBODIMENT

Figure 8:
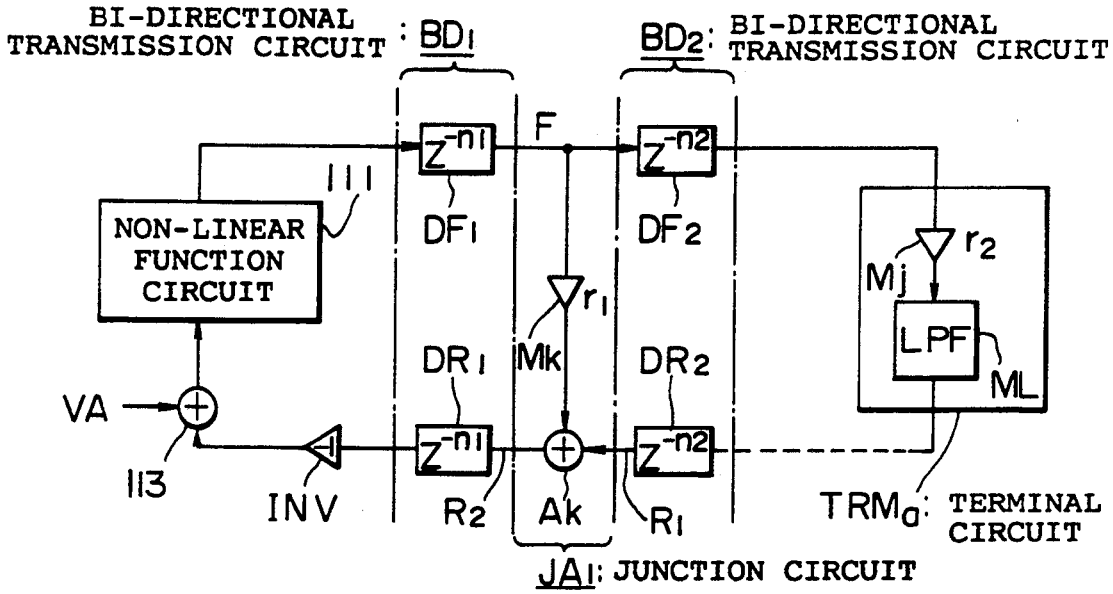
FIG. 8 is a block diagram showing the musical tone synthesizing apparatus according to a second embodiment of the present invention.

FIG. 8 is a block diagram showing the musical tone synthesizing apparatus according to the second embodiment of the present invention. In FIG. 8, 111 designates a non-linear function circuit; 113 designates an adder; INV designates an inverter; $BD_1$, $BD_2$ designate bi-directional transmission circuits; $JA_1$ designates a junction circuit including a multiplier Mk and an adder Ak; and TRMa designates a terminal circuit consisting of a multiplier Mj and a low-pass filter (LPF) ML.

The junction circuit $JA_1$ directly transmits progressive wave data F from the bi-directional transmission circuit $BD_1$ to next bi-directional transmission circuit $BD_2$. In the junction circuit $JA_1$, the multiplier Mk multiplies the progressive wave data F by a coefficient $r_1$, and then the multiplication result is added to reflected wave data $R_1$. The addition result of the adder Ak is transmitted to the hi-directional transmission circuit $BD_1$ as reflected wave data $R_2$. Herein, the coefficient $r_1$ used in the multiplier Mk is changed over by control means (not shown) in response to the operation of the tone hole. For example, this coefficient $r_1$ is set at the relatively small value when the tone hole is closed, while $r_1$ is set at the relatively large value when the tone hole is opened. As the method of changing over the coefficient $r_1$, the following two methods can be employed. In first method, one of the predetermined two values is selected in response to the open/close state of the tone hole. In second method, the value of $r_1$ is continuously varied in response to the substantial opening area of the tone hole when the performer actually performs the wind instrument by opening or closing each tone hole.

In the terminal circuit TRMa, the multiplier Mj multiplies the progressive wave data F by a coefficient $r_2$, and then the multiplication result is subject to the filtering operation in the LPF ML. Thereafter, the output of the LPF ML is transmitted from the terminal circuit TRMa as reflected wave data. Herein, the coefficient $r_2$ used in the multiplier Mj is changed over by control means (not shown) in synchronism with the foregoing change-over operation of $r_1$. More specifically, when the tone hole is closed, $r_1$ is set smaller but $r_2$ is set larger. On the other hand, when the tone hole is opened, $r_1$ is set larger but $r_2$ is set smaller. In the present embodiment, the following relation can be established between the coefficients $r_1$, $r_2$.

$$r_1+r_2 \leqq 1 \quad (30)$$

The reflected wave data is transmitted through $BD_2$, $JA_1$, $BD_1$ etc. and then supplied to the inverter INV. The inverter INV inverts the reflected wave data $R_2$, and then the inverted data is fed back to the adder 113.

In the present embodiment, the output data of the non-linear function circuit 111 will reach at the terminal circuit TRMa as the progressive wave data without being attenuated. When the tone hole is closed, the coefficient $r_2$ is set larger so that the progressive wave data is supplied to the LPF ML without being substantially attenuated. Then, the LPF ML carries out the filtering operation which simulates the acoustic loss to be caused at the terminal portion of the resonance tube of the wind instrument. Thereafter, the terminal circuit TRMa will transmit the reflected wave data toward the adder 113. In such transmission, the reflected wave data must pass through the junction circuit $JA_1$ wherein the multiplication coefficient $r_1$ is set smaller. Therefore, in the junction circuit $JA_1$, the progressive wave data is not substantially mimed in the reflected wave data. In this case, the resonance frequency is substantially determined by the time which is required when the output data of the non-linear function circuit 111 is transmitted through $BD_1$, $BD_2$, $JA_1$, TRMa etc. in forward and backward directions.

On the other hand, when the tone hole is opened, the coefficient $r_2$ is set smaller so that the progressive data is attenuated and then supplied to the LPF ML in the terminal circuit TRMa. In this case, the reflected wave data can be negligible. In addition, the coefficient $r_1$ is set larger in the junction circuit $JA_1$ corresponding to the tone hole which is opened. Thus, the progressive wave data is not substantially attenuated by the multiplier Mk and then transmitted toward the adder 113 as the reflected wave data. In this case, the resonance frequency can be substantially determined by the time which is required when the output data of the non-linear function circuit 111 is transmitted through $BD_1$, $BD_2$, $JA_1$, TRMa in forward and backward directions.

In the above-mentioned case, the coefficients $r_1$, $r_2$ are determined in accordance with the foregoing formula (30), so that the closed-loop gain in the circuit shown in FIG. 8 can be normally held at the value lower than "1". Thus, it is possible to avoid the mulfunctional phenomenon where the present apparatus as a whole is set in the oscillating state.

(1) First Modified Example

Next, description will be given with respect to the first modified example of the second embodiment by referring to FIGS. 9 and 10.

Meanwhile, when the tone hole is opened, the progressive wave data reached at the junction circuit $JA_1$ is directly transmitted toward the adder 113 as the reflected wave data in the foregoing second embodiment as shown in FIG. 8. In other words, the second embodiment neglects the acoustic loss when the tone hole is opened.

Figure 9:
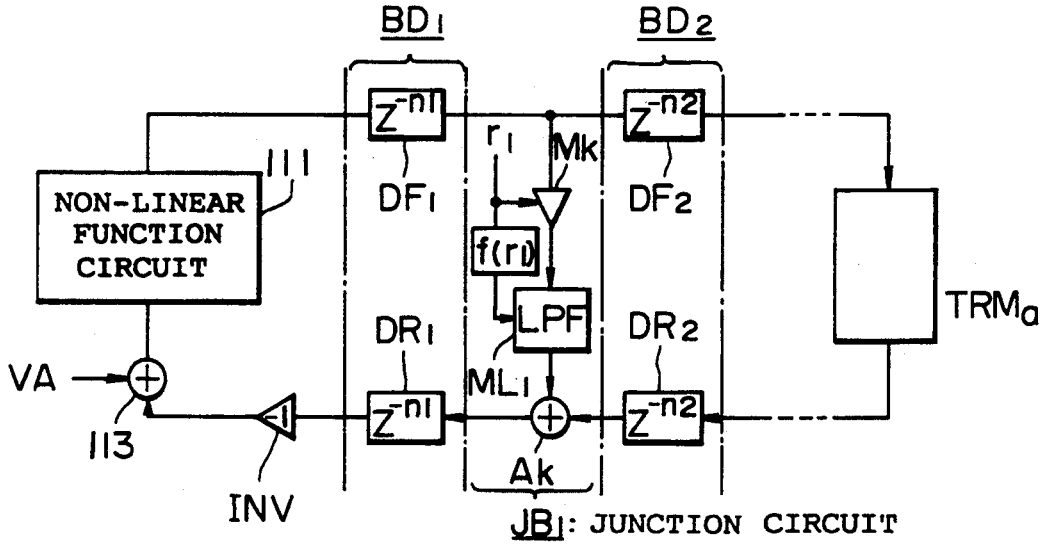
FIG. 9 is a block diagram showing the musical tone synthesizing apparatus according to a first modified example of the second embodiment.
Figure 10:
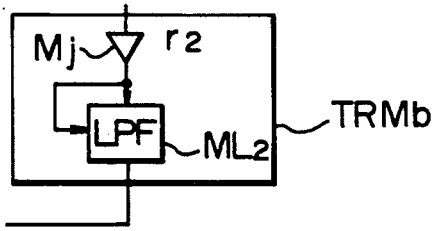
FIG. 10 is a circuit diagram showing a terminal circuit shown in FIG. 9.

However, in the case where the acoustic loss cannot be neglected, the second embodiment shown in FIG. 8 is modified to the first modified example as shown in FIG. 9. Instead of the junction circuit $JA_1$ shown in FIG. 8, the present example uses a junction circuit $JB_1$ as shown in FIG. 9. In this junction circuit $JB_1$, the multiplier Mk multiplies the progressive wave data by the foregoing coefficient $r_1$, and then the multiplication result is subject to the filtering operation in a LPF $ML_1$. Thereafter, the output data of the LPF $ML_1$ is transmitted as the reflected wave data via the adder Ak. Herein, the cut-off frequency of LPF $ML_1$ can be changed over in response to function $f(r_1)$ using the coefficient $r_1$ as its parameter.

When the tone hole is closed so that the coefficient $r_1$ is set smaller, the cut-off frequency of LPF $ML_1$ is controlled to be higher. On the other hand, when the tone hole is opened so that $r_1$ is set larger, the cut-off frequency of LPF $ML_1$ is controlled to be lower. In addition, when the tone hole is opened, the progressive wave data is subject to the filtering operation corresponding to the acoustic loss in the tone hole in the LPF $ML_1$, and then the output data of LPF $ML_1$ is outputted as the reflected wave data.

Instead of the terminal circuit TRMa, it is possible to employ another terminal circuit TRMb to be connected to the circuit shown in FIG. 9. As similar to TRMa, this terminal circuit TRMb consists of the multiplier Mj and LPF $ML_2$. Herein, the cut-off frequency of LPF $ML_2$ is set higher when the output of multiplier Mj is relatively small, while the cut-off frequency of LPF $ML_2$ is set lower when the output of Mj is relatively large. By connecting several terminal circuits such as TRMb, it is possible to perform the experiment wherein the musical tone can be examined in response to the open/close state of the tone hole of the wind instrument which is blown.

(2) Second Modified Example

Figure 11:
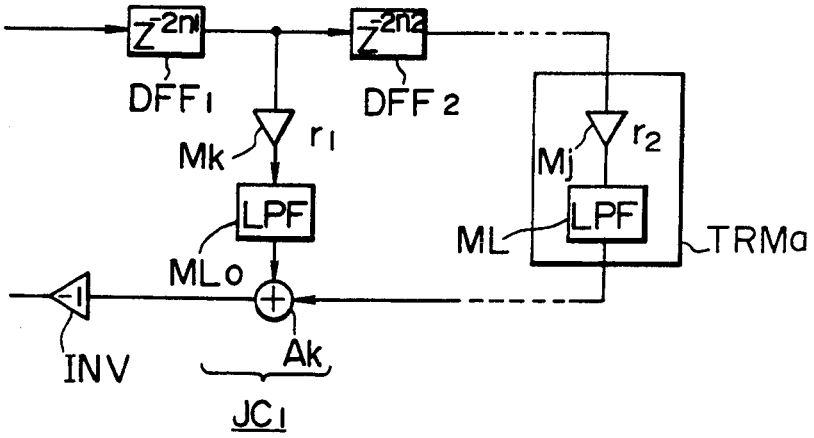
FIGS. 11, 12, 13 are block diagrams showing second, third and fourth modified examples of the second embodiment respectively.

FIG. 11 shows the second modified example of the second embodiment. In contrast to the foregoing second embodiment which uses the delay circuits for both of the progressive wave data and reflected wave data, the present example uses delay circuits $DFF_1$, $DFF_2$ etc. only for the progressive wave data to be transmitted toward the terminal circuit TRMa. Herein, each of the delay circuits $DFF_1$, $DFF_2$, . . . has the delay time corresponding to the sum of the delay times of delay circuits DFi, DRi (where i=1 to n) in the second embodiment shown in FIG. 8. Thus, the present example can perform the pitch control as similar to that of the second embodiment. Instead of the junction circuit $JA_1$ shown in FIG. 8, the present example uses a junction circuit $JC_1$ consisting of the multiplier Mk and a LPF $ML_0$. The output of multiplier Mk is subject to the filtering operation corresponding to the acoustic loss in the tone hole in the LPF $ML_0$.

The present example is characterized by that it is possible to reduce the number of delay circuits as comparing to that of the foregoing second embodiment and its first modified example, so that the size of the present example can be reduced. Further, by employing the digital signal processor in the musical tone synthesizing apparatus according to the second modified example, it is possible to reduce the amount of operational processes as comparing to that of the foregoing second embodiment and its first modified example.

(3) Third Modified Example

Figure 12:
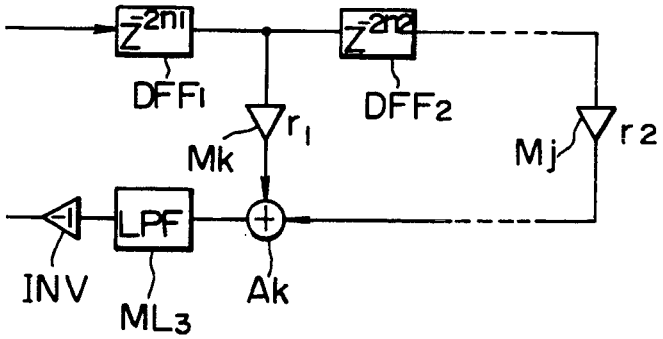

FIG. 12 shows the third modified example of the second embodiment. As comparing to the foregoing second modified example as shown in FIG. 11, the third modified example as shown in FIG. 12 omits the LPFs ML, $ML_0$ but newly provides another LPF $ML_3$ prior to the inverter INV. The filtering operation of this LPF $ML_3$ simulates the acoustic loss to be caused at the tone hole and opening end as a whole. This third modified example is characterized by further reducing the number of elements to be required to configure the musical tone synthesizing apparatus.

(4) Fourth Modified Example

Figure 13:
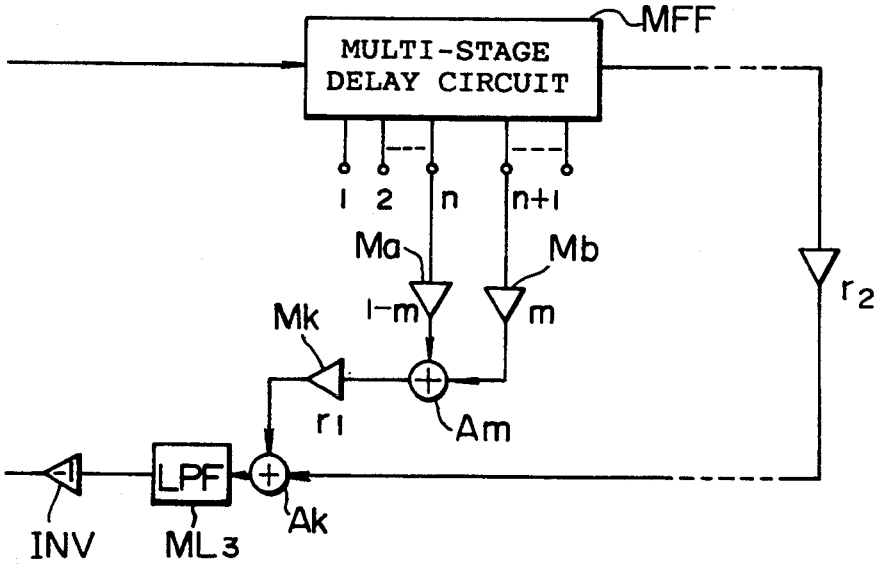

FIG. 13 shows the fourth modified example of the second embodiment. In contrast to the foregoing third modified example wherein the output of DFF is directly supplied to the multiplier Mk, the fourth modified example uses a multi-stage delay circuit MFF which is used instead of the delay circuits $DFF_1$, $DFF_2$ etc. Then, n-stage output and (n+1)-stage output of this multi-stage delay circuit MFF are respectively multiplied by coefficients (1−m), m in multipliers Ma, Mb. Thereafter, an adder Am adds two multiplication results from the multipliers Ma, Mb together, and its addition result is supplied to the multiplier Mk.

Herein, the whole delay time of the multi-stage delay circuit MFF is set equal to the sum of delay times of the delay circuits $DFF_1$, $DFF_2$. Meanwhile, data pick-up positions of MFF to be connected to Ma, Mb are determined in accordance with the positions of the tone holes in the wind instrument. In addition, the coefficients (1−m), m to be used for n-stage, (n+1)-stage of MFF are used to carry out the linear interpolation on the progressive wave data. For example, the value ranging from "0" to "1" is used as such coefficients (1−m), More specifically, the following linear interpolation operation is carried out on n-stage output F(n), (n+1)-stage output F(n+1) of MFF.

$$FT=(1-m)F(n)+mF(n+1) \quad (31)$$

Thus, the addition result of the adder Am can be represented by FT in the above formula. Therefore, the progressive wave data which simulates the compression wave of air at the actual position of the tone hole is to be outputted via the multiplier Mk and adder Ak as the reflected wave data.

Thus, the present example can perform the musical tone synthesizing control corresponding to the pitch-bend or vibrato performance. More specifically, when the pitch-bend control is carried out, the coefficients (1−m), m are varied in accordance with the predetermined curve after the tone-generation is started, so that these coefficients will be converged on the values corresponding to the regular positions of the tone holes after the predetermined time is passed. Thus, the pitch can be bent when starting to generate the musical tone, so that the pitch-bend performance can be embodied. In case of the vibrato performance, these coefficients are varied in the sine-wave manner, for example. Thus, the pitch can be intermittently varied, so that the vibrato performance can be embodied.

In the second embodiment and its modified examples, the non-linear function circuit 111 is constructed by ROM. However, it is possible to construct the non-linear function circuit 111 by the random-access memory (RAM), operation circuit and other non-linear elements. Of course, the present embodiment is not limited to synthesize the wind instrument tone, hence, it is possible to synthesize the string instrument tone in which the size of string is not constant in one string, and also synthesize the reverberation effect applied tone and the like in the complicated three-dimensional space.

As described heretofore, this invention may be practiced or embodied in still other ways without departing from the spirit or essential character thereof. Therefore, the preferred embodiments described herein are illustrative and not restrictive, the scope of the invention being indicated by the appended claims and all variations which come within the meaning of the claims are intended to be embraced therein.

What is claimed is:

1. A musical tone synthesizing apparatus comprising:

(a) first, second and third signal processing means each delaying a respective input signal thereof by a predetermined delay time and providing a respective output signal, wherein at least one of said first, second and third signal processing means varies the level of the input signal thereof in addition to delaying the input signal thereof with the predetermined delay time;

(b) pitch control means, connected to said third signal processing means, for controlling the pitch of the musical tone in accordance with a first coefficient;

(c) connecting means, which connects said first, second and third signal processing means together, for carrying out a predetermined operational process on the respective output signals of said first, second and third signal processing means to generate first, second and third progressive waves and first, second and third reflected waves responsive to said pitch control means, and for feeding back the respective progressive waves and reflected waves to each of said first, second and third signal processing means, wherein a synthesized musical tone signal is obtained based on a signal picked up from one of said first, second and third signal processing means and said connecting means.

2. A musical tone synthesizing apparatus comprising:

(a) excitation means for generating an excitation signal in response to performance information of a musical instrument;

(b) bi-directional transmission means for propagating said excitation signal outputted from said excitation means to a terminal portion as a progressive wave signal and also feeding back at least a portion of said excitation signal from said terminal portion toward said excitation means as a reflected wave signal, wherein a synthesized musical tone signal is obtained by setting both of said excitation means and said bi-directional transmission means at resonance states respectively;

(c) pitch information generating means for generating first and second coefficients concerning pitch information in response to said performance information, both of said first and second coefficients being used to designate a pitch of a musical tone to be generated;

(d) connecting means inserted in said bi-directional transmission means at a mid position thereof which is determined such that a predetermined pitch can be obtained, said progressive wave signal when it reaches said mid position is multiplied by said first coefficient and the multiplication result is added to said reflected wave signal which has reached said mid position of said bi-directional transmission means toward said excitation means; and (e) terminal means connected at said terminal portion of said bi-directional transmission means, said progressive wave signal supplied to said terminal means being multiplied by said second coefficient to thereby output its multiplication result as said reflected wave signal, wherein the sum of said first and second coefficients is set lower than a predetermined value.

3. A musical tone synthesizing apparatus which simulates a resonance tube of a musical instrument having plural sound holes each opened or closed by each finger of a performer comprising:

(a) first and second signal processing means each delaying an input signal thereof with a predetermined delay time;

(b) junction means for carrying out a predetermined operational process on output signals of said first and second signal processing means to effect a scattering operation on the output signals of said first and second signal processing means in which each output signal is scattered among different paths within the junction means, and wherein respective output signals of said junction means are fed back to said first and second signal processing means; and (c) computing means for computing open/close-degree of said sound hole to thereby produce sound hole information, said sound hole information representing an or opened or closed state of said sound hole ranging between a full-open state and a full-closed state; and coefficient generating means for generating coefficients in accordance with the sound hole information, wherein said coefficients are used in said operational process to be carried out by said junction means so that a synthesized musical tone signal which simulates said musical instrument providing said resonance tube with plural sound holes is obtained based on a signal picked up from a loop including said first and second signal processing means and said junction means.

4. A musical tone synthesizing apparatus which simulates a resonance tube of a musical instrument having at least one sound hole which is opened or closed by a finger of a performer, the musical tone synthesizing apparatus comprising:

(a) first and second signal processing means each for delaying a respective input signal thereof by a predetermined delay time and providing an output signal;

(b) sound hole information generating means for generating sound hole information which gradually varies between a first value and a second value to simulate the gradual opening and closing of a sound hole;

(c) coefficient generating means for generating varying coefficients in accordance with the sound hole information outputted from said sound hole information generating means; and (d) junction means for carrying out a predetermined operational process on output signals of said first and second signal processing means to generate progressive compression waves and reflected compression waves, wherein the predetermined process is based on the values of the output signals of said first and second signal processing means and the coefficients, and for providing respective generated progressive compression and reflected compression waves back to said first and second signal processing means, wherein a synthesized musical tone signal is obtained based on a signal picked up from a loop including said first and second signal processing means and said junction means.

5. A musical tone synthesizing apparatus comprising:

(a) first, second and third signal processing means each delaying a respective input signal thereof by a predetermined delay time and providing a respective output signal;

(b) pitch control means, connected to said third signal processing means, for controlling the pitch of the musical tone in accordance with a first coefficient;

(c) connecting means, which connects said first, second and third signal processing means together, for carrying out a predetermined operational process on the respective output signals of said first, second and third progressing means to generate first, second and third progressive waves and first, second and third reflected waves responsive to said pitch control means, and for feeding back the respective progressive waves and reflected waves to each of said first, second and third signal processing means, wherein a synthesized musical tone signal is obtained based on a signal picked up from one of said first, second and third signal processing means and said connecting means, wherein the pitch control means comprises multiplying means for multiplying a predetermined coefficient with the input signal which is inputted into said third signal processing means and filtering means for filtering the input signal.

6. A musical tone synthesizing apparatus comprising:

(a) first, second and third signal processing means each delaying a respective input signal thereof by a predetermined delay time and providing a respective output signal;

(b) pitch control means, connected to said third signal processing means, for controlling the pitch of the musical tone in accordance with a first coefficient;

(c) connecting means, which connects said first, second and third signal processing means together, for carrying out a predetermined operational process on the respective output signals of said first, second and third signal processing means to generate first, second and third progressive waves and first, second and third reflected waves responsive to said pitch control means, and for feeding back the respective progressive waves and reflected waves to each of said first, second and third signal processing means, wherein a synthesized musical tone signal is obtained based on a signal picked up from one of said first, second and third signal processing means and said connecting means; and (d) coefficient generating means for generating the first coefficient to thereby control the pitch of the musical tone.

7. A musical tone synthesizing apparatus according to claim 6 wherein said coefficient generating means also generates a second coefficient which controls the amount of feeding back of the progressive compression waves and reflected compression waves.

8. A musical tone synthesizing apparatus comprising:

(a) first and second signal processing means each delaying an input signal thereto by a predetermined delay time;

(b) pitch control information generating means for generating pitch control information which varies within a range of predetermined first and second pitches;

(c) coefficient generating means for generating at least first and second coefficients in accordance with the pitch control information generated by said pitch control information generating means; and (d) junction means for carrying out a predetermined operational process on output signals of said first and second signal processing means to thereby generate progressive waves and reflected waves based on the output signal of said first and second signal processing means and the first and second coefficients, and for feeding back the respective progressive waves and reflected waves to said first and second signal processing means, wherein a synthesized musical tone signal is obtained based on a signal picked up from a loop including said first and second signal processing means and said junction means.

* * * * *